US005653282A

United States Patent [19]

Hackemesser et al.

[11] Patent Number: 5,653,282

[45] Date of Patent: Aug. 5, 1997

[54] SHELL AND TUBE HEAT EXCHANGER WITH IMPINGEMENT DISTRIBUTOR

[75] Inventors: Larry Gene Hackemesser, Houston; Lloyd Edward Cizmar, Missouri City; Robert Stevens Burlingame, Houston, all of Tex.

[73] Assignee: The M. W. Kellogg Company, Houston, Tex.

[21] Appl. No.: 504,278

[22] Filed: Jul. 19, 1995

[51] Int. Cl.[6] ..... F28D 7/00

[52] U.S. Cl. ..... 165/134.1; 165/159; 165/DIG. 402

[58] Field of Search ..... 165/134.1, 159, 165/DIG. 402, 174

[56] References Cited

U.S. PATENT DOCUMENTS 1,815,932 7/1931 Seider ..... 165/159

1,848,197 3/1932 Ray et al. ..... 165/DIG. 402

2,655,350 10/1953 Gaylord, Jr. ..... 165/DIG. 402

3,180,408 4/1965 Grotz, Jr. et al. ..... 165/159 X 3,398,789 8/1968 Wolowodiuk et al. ..... 165/159 X 4,576,222 3/1986 Granata, Jr. et al. ..... 165/76

*Primary Examiner*—Allen J. Flanigan

*Attorney, Agent, or Firm*—The M. W. Kellogg Company

[57] ABSTRACT

An impingement distributor for a shell and tube heat exchanger and a method of recovering waste heat from a hot gas which minimizes adverse heat flux at the outermost banks of tubes for enhanced operational reliability. The impingement distributor has a cylindrical distribution plate having evenly arranged rows of longitudinal perforations and a plurality of impact bars longitudinally aligned with the perforations. The hot fluid impinges on the impact bars, and direct impingement on the tubes is avoided.

21 Claims, 8 Drawing Sheets

SHELL AND TUBE HEAT EXCHANGER WITH IMPINGEMENT DISTRIBUTOR

FIELD OF THE INVENTION

The present invention relates to an improved shell and tube heat exchanger and, more particularly, to a waste heat boiler having an impingement distributor for the inlet gas to reduce the peak heat flux on the outermost tubes.

BACKGROUND OF THE INVENTION

Waste heat boilers are commonly employed in manufacturing plants to recover heat from exhaust gases produced in high temperature processes such as steam reforming, catalytic cracking, coal gasification, power turbine operations, and the like. Water tube waste heat boilers typically comprise shell and tube heat exchangers wherein the hot incoming exhaust gas is directed to the shell side. Boiler water flowing through the tube side is heated and partially vaporized.

The tubes of such high temperature heat exchangers are subject to failure when the mechanical integrity of the wall is undermined by factors such as corrosion, scaling or fouling from low quality boiler water and by erosion due to the impinging inlet gas. For example, tube-side fouling increases the tube wall temperature which, in severe cases, can result in tube failure due to overheating. Severity of the operating conditions, including excessive heat flux, can exacerbate integrity problems and increase sensitivity to changes in the quality of boiler water.

The reliability of the waste heat boiler can be significantly improved even in circumstances where the boiler water quality fluctuates by addressing the problem of excessive heat flux distribution and impingement, particularly, on the outermost tubes closest to the hot gas inlet.

SUMMARY OF THE INVENTION

By deflecting impingement of hot incoming gas from the walls of the outermost bank of tubes in a shell and tube heat exchanger, sensitivity of such outer tubes to fluctuation in boiler water quality can be reduced for improved reliability.

In one aspect, the present invention provides an improved shell and tube exchanger. As a first element, a tube bundle generally longitudinally disposed in the shell is provided for passing a tube-side fluid through the exchanger. As another element, a shell-side inlet is provided in fluid communication with an annular distribution channel defined by a cylindrical distributor plate disposed around the tube bundle and spaced from an inside surface of the shell. A plurality of perforations formed in the distributor plate are provided to distribute fluid from the annular channel to flow through the tube bundle across outer surfaces of the tubes to a shell-side fluid outlet. A plurality of impact bars are disposed between a bank of outer tubes of the bundle and an inner surface of the distributor plate. The bars face the perforations for fluid passing through the perforations to impinge on the bars. The perforations can be arranged in a plurality of longitudinal rows and an impact bar longitudinally aligned with each row of perforations and running the general length thereof.

In a preferred embodiment, first and second annular seal plates are provided at opposite ends of the distribution channel extending outward radially from the distributor plate to adjacent the inside surface of the shell. The exchanger includes one or more distributor baffles extending outward radially from the tube bundle to adjacent the inner surface of the distributor plate. Notches are formed in an outer profile of the distributor baffle or baffles to radially receive the impact bars and maintain radial alignment of the tube bundle with respect to the distributor plate and impact bars.

In one arrangement, tubes preferably have a radial pitch and the impact bars are aligned with longitudinal gaps between adjacent tubes in the outer bank. The exchanger includes a plurality of longitudinally spaced-apart guide rings secured to the distributor plate and extending inward radially therefrom. Longitudinal holes are formed in the guide rings to receive the impact bars and maintain them in radial alignment. The guide rings preferably have an inner profile corresponding to a contour of the outer tube bank. Some of the impact bars can comprise tie rods generally running the length of the tube bundle to provide structural support for baffles and support plates.

In another arrangement, the impact bars have a concave surface disposed adjacent the inner surface of the distributor plate and spaced therefrom. The impact bars are preferably aligned with adjacent tubes in the outer bank. The impact bars are preferably attached to the distributor plate by bolts and spaced from the inner surface thereof by spacers.

In another aspect, the present invention provides a waste heat boiler having a refractory-lined cylindrical shell housing a longitudinal tube bundle and including respective tube-side and shell-side fluid inlets and outlets. A plurality of baffles are perforated to slideably receive and maintain radial alignment of tubes in the tube bundle. The baffles are spaced apart longitudinally by tie rods which pass through bores in the baffles and through annular spacing elements having an outer diameter larger than the bores. A cylindrical distributor plate is disposed around the tube bundle and radially spaced from an inside surface of the shell to form a hot gas inlet annulus in fluid communication with the shell-side fluid inlet. Upper and lower seal plates are secured adjacent opposite longitudinal upper and lower ends of the distributor plate and extend outward radially therefrom to adjacent the inside surface of the shell to form fluid seals at respective ends of the hot gas inlet annulus. One of the baffles is a support baffle extending outward radially from the tube bundle to adjacent the inside surface of the shell below the lower end of the distributor plate to support the distributor plate on an upper surface of the support baffle. A plurality of perforations are formed in the distributor plate, arranged in spaced-apart longitudinal rows. A plurality of longitudinal impact bars are disposed adjacent an outer periphery of the tube bundle and the distributor plate. Each of the impact bars so disposed is aligned with and opposes a row of the perforations for hot gas passing through the perforations to impinge directly on a respective impact bar, and then pass between adjacent impact bars into the tube bundle. One or more of the baffles are distributor baffles extending outward radially from the tube bundle between the longitudinal ends of the distributor plate, and include an outer contour adjacent an inside surface of the distributor plate having peripheral notches to laterally receive the impact bars and maintain radial alignment of the tube bundle and tie rods with respect to the impact bars and distributor plate. One of the baffles is preferably a support baffle extending outward radially from the tube bundle to adjacent the inside surface of the shell above the upper end of the distributor plate to vertically position the distributor plate between the upper and lower support baffles. The baffles are preferably in a disk and donut configuration. The support baffles are preferably configured as donuts; the distributor baffles as disks.

In one arrangement, some of the impact bars can be tie rods. A plurality of guide rings are secured at spaced intervals along the length of the distributor plate and extend inward radially therefrom to an inner profile corresponding to a radial contour of the tube bundle and tie rods. The guide rings are perforated to receive and maintain the impact bars in the alignment with the rows of perforations. The impact bars and tie rods opposite the perforations in the waste heat boiler are preferably arranged in a circle concentric with the distributor plate. The tubes are also preferably arranged in a circular pattern concentric with the distributor plate, and the perforations in the distributor plate are preferably aligned with a gap between adjacent tubes in an outermost bank. The impact bars are preferably secured to one of the guide rings and slideably received in the perforations of the other guide rings to allow for longitudinal thermal expansion.

In another arrangement, the impact bars have a concave surface disposed adjacent the inner surface of the distributor plate and spaced therefrom. The perforations in the distributor plate are preferably aligned with adjacent tubes in an outermost bank. The impact bars are preferably attached to the distributor plate by bolts and spaced from the inner surface thereof by spacers.

As another embodiment, the present invention provides a method for recovering waste heat from a hot gas stream. As one step, a hot gas stream is directed to an annular distribution channel of a shell and tube heat exchanger. The heat exchanger has a tube bundle generally longitudinally disposed in the shell for passing a tube-side fluid through the exchanger. The annular distribution channel communicates with fluid from a shell-side inlet and is defined by a cylindrical distributor plate disposed around the tube bundle and spaced from an inside surface of the shell. Hot gas is distributed from the annular channel to flow through the tube bundle across outer surfaces of the tubes to a shell-side outlet by a plurality of perforations formed in the distributor plate. Gas is passed through the perforations and impinged against a plurality of impact bars disposed between a bank of outer tubes of the bundle and an inner surface of the distributor plate wherein the bars face the perforations. Heat from the gas distributed by the distributor plate is exchanged with the flow through the tube bundle. A cooled gas is withdrawn from the shell side outlet, and a heated fluid is withdrawn from a tube-side outlet.

DETAILED DESCRIPTION OF THE INVENTION

A perforated distributor in conjunction with impact rods aligned with the perforations significantly improves the flow and heat flux distribution to the outer tubes of a shell and tube heat exchanger.

Referring to FIGS. 1–15, wherein like numerals refer to similar parts, embodiments 10, 100 of the shell and tube heat exchanger of the present invention exemplified but not limited to a waste heat recovery boiler comprises a shell 12 having mounted therein a tube bundle 14 equipped with impingement distributors 16, 102 of the present invention.

Figure 1:
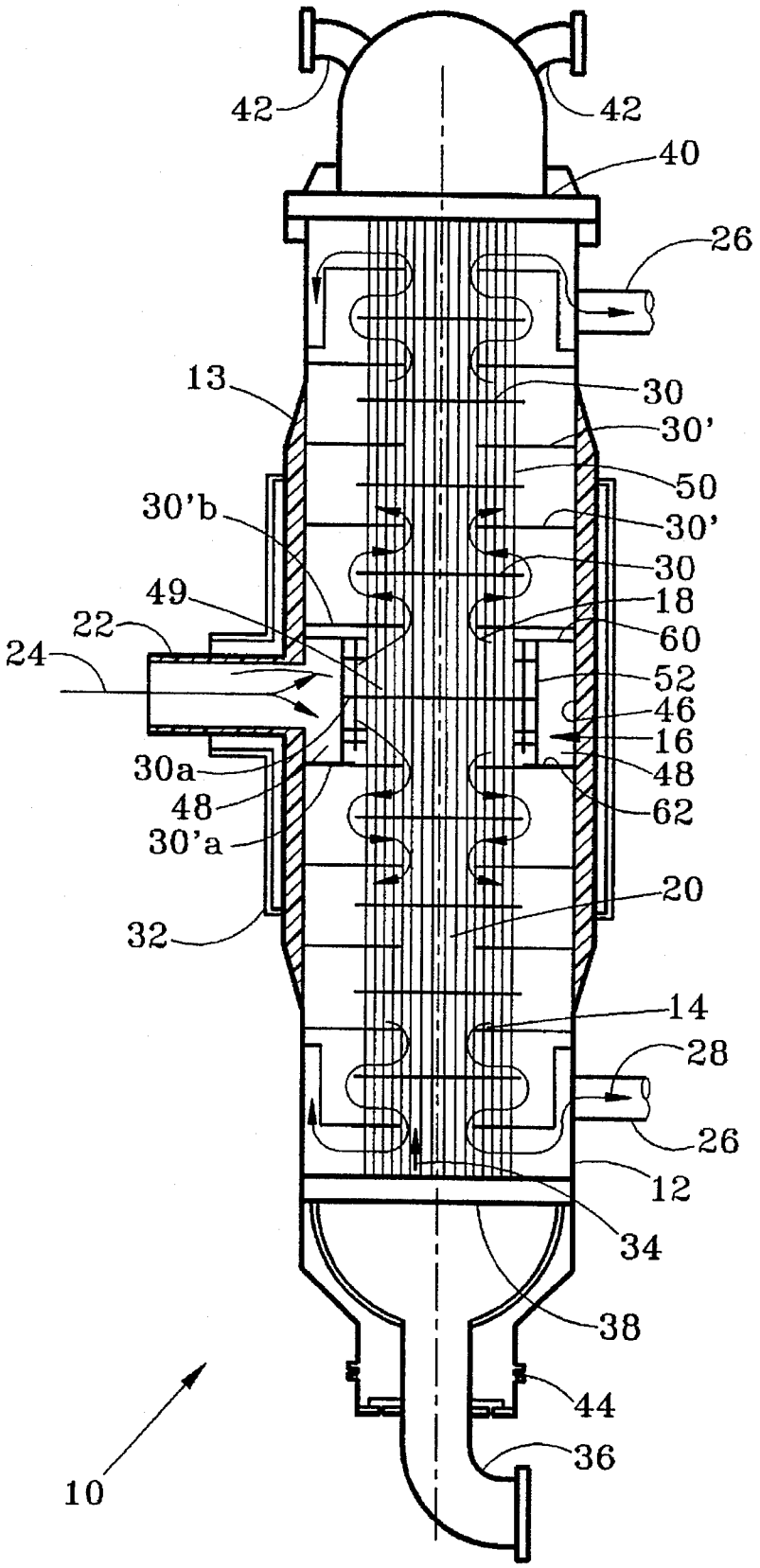
FIG. 1 is a longitudinal cross-sectional view of a shell and tube boiler showing one embodiment of the impingement distributor of the present invention on the shell-side gas inlet.
Figure 2:
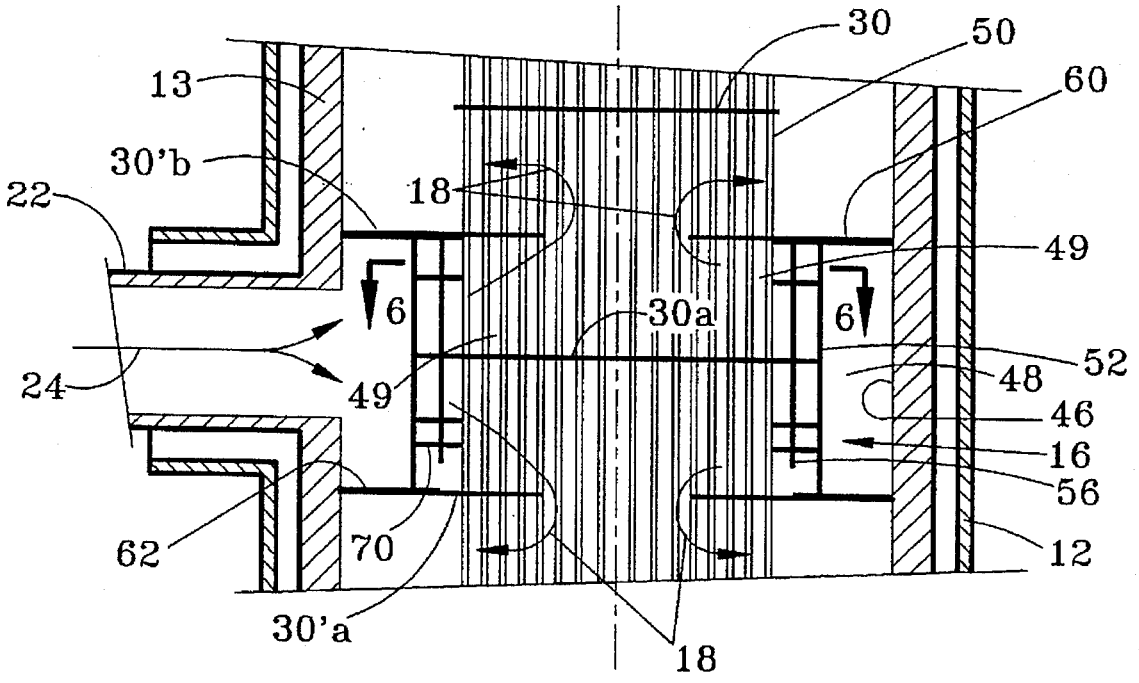
FIG. 2 is an enlarged longitudinal cross-sectional view of the impingement distributor of FIG. 1 showing impact bars 56 and supporting guide rings 70.

As is well known in the art, the shell 12 comprises a shell-side path 18 for establishing shell-side fluid contact with an exterior surface of tubes 20. The shell 12 includes one or more inlet nozzles 22 for the introduction of a hot shell-side fluid 24 and one or more outlet nozzles 26 for the withdrawal of a fluid 28 having a reduced thermal state. The path 18 is defined by a plurality of axially mounted disk and donut type baffle plates 30, 30' to facilitate generally complete heat exchange contact with the exterior surfaces of the tubes 20. It is well understood that the exact number and configuration of the inlet and outlet nozzles 22, 26 and baffle plates 30, 30' will be a matter for practitioner preference depending on many factors such as types of streams involved, heat exchange requirements, process economics, and the like. In addition as seen in FIG. 1, the shell 12 can include a cooling jacket 32 to cool and protect the shell 12 in the event of a refractory failure.

Heat is exchanged from the shell-side fluid to a tube-side fluid passing through a tube-side path 34 of the tube bundle 14. The tube-side path 34 as is well known in the art comprises one or more inlet nozzles 36, an inlet tube sheet 38 for distributing the tube-side fluid to the tubes 20 and mechanical support thereof, an outlet tube sheet 40 and one or more outlet nozzles 42.

For ease of mounting, maintenance and manufacture, the tube bundle 14 is generally assembled as a self-contained unit of the tubes 20 gathered at either end by the tube sheets 38, 40 and providing a base for attaching the shell-side baffle plates 30, 30'. Means for supporting the tube bundle 14 for permitting necessary thermal expansion in the shell 12 are well known. Typically only one end of the bundle 14 is bolted to the shell 12, for example, at the tube sheet 40. The other end "floats" inside the shell 12, and the shell 12 is provided with an expansion joint 44 at the inlet nozzle 36 for expansion and contraction thereof.

Means for supporting the baffle plates 30, 30' are also well known. The baffle plates 30, 30' are perforated to slideably receive and maintain radial alignment of tubes 20 in the tube bundle 14. The baffles 30, 30' are spaced apart longitudinally by a plurality of tie rods 45 (see FIGS. 4–6) which pass through bores in the baffles and through annular spacing elements 47 having an outer diameter larger than the bores. The tie rods 45 (preferably as two connected sections) typically extend the length of the tube bundle 14, and are generally attached to either of the tube sheets 38, 40. The plates 30, 30' and spacers 47 are interposed along the tie rods 45 in an alternating fashion. Thus, the spacers 47 hold the baffles 30, 30' in longitudinal position, and the perforations in the baffles 30, 30' maintain the tubes 20 in relative radial position. The disk and donut shaped plates 30, 30' are also generally alternated as seen in FIG. 1 to enhance cross-flow of the hot gas across the outer surface of the tubes 20.

In accordance with the present invention, the cylindrical impingement distributors 16, 102 are mounted and supported around the perimeter of the tube bundle 14 and spaced from an inside surface 46 of the shell 12 adjacent the shell-side inlet nozzle 22. The distributors 16, 102 define an annular distribution channel 48 to evenly distribute the incoming shell-side fluid to an inlet 49 of the shell-side path(s) 18 and reduce direct impingement of the hot incoming fluid on an outermost tube bank 50.

The impingement distributors 16, 102 of the present invention comprise a distributor plate 52 having a plurality of perforations 54 formed therein. A plurality of longitudinally mounted impact bars 56, 104 are disposed between the outer tube bank 50 and an inner surface of the distributor plate 52 facing the perforations 54 (see FIGS. 4–9). The perforations 54 are arranged in a plurality of longitudinal columns and an impact bar is longitudinally aligned with each column of perforations and runs the general length thereof.

Preferred position of the impact bars 56, 104 with respect to the outer tubes of the tube bank 50 will depend on the cross-sectional geometry of the bar and the pitch of the tubes. For an impact bar having a convex cross-section and the tubes having a circumferential pitch, impact bars 56 are desirably aligned with a longitudinal gap 57 between adjacent tubes in the outer bank 50 to define indirect flow path 58 as seen in FIGS. 4–6 and 11–12. In such a manner, the bars 56 can be positioned to deflect impinging gases around the sides thereof and through the gap 57 thus avoiding direct impingement on the outermost tubes. Examples of suitable cross-sections for the impact bar 56 are circular, elliptical, rectangular, oval, and the like with a circular cross-section being preferred. If an elongated cross-section is used, the flatter surface is preferably longitudinally aligned to the column of perforations.

Figure 8:
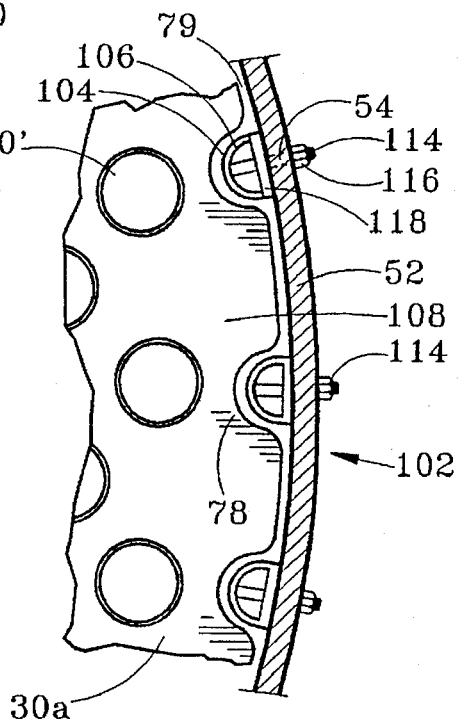
FIG. 8 is a partial plan view of a distributor baffle in the impingement distributor of FIG. 7 taken along the lines 8—8 showing the impact bars 104 aligned with the tubes of the outer tube bank.
Figure 15:
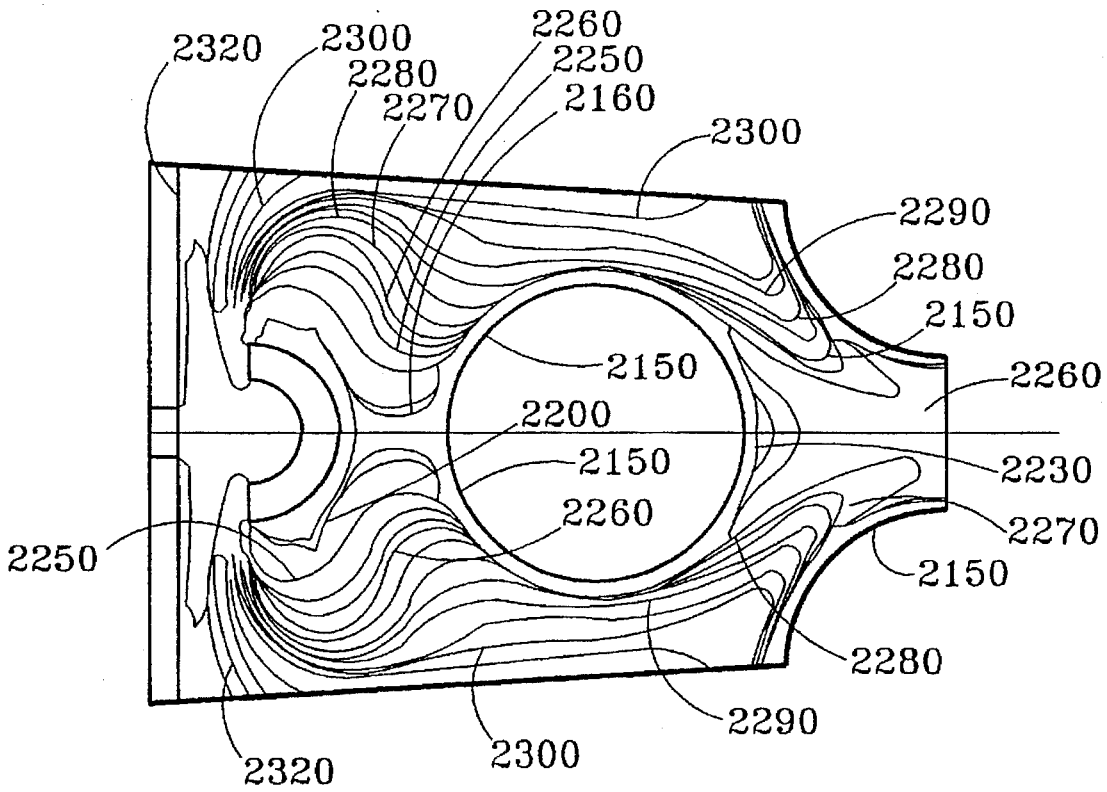
FIG. 15 illustrates computer simulated isotherms in the waste heat boiler of FIG. 14.
Figure 16:
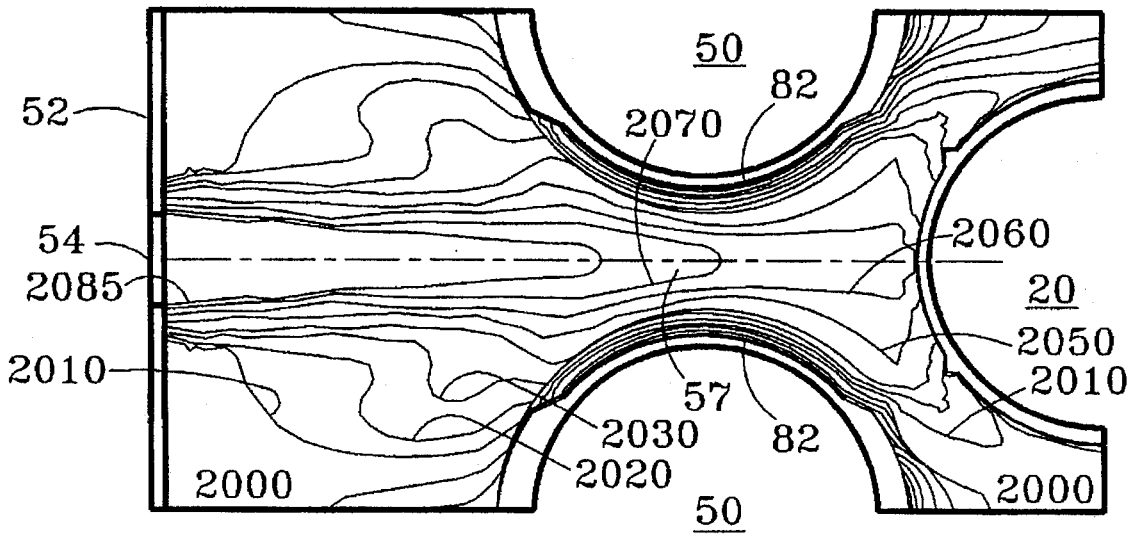
FIG. 16 (prior art) illustrates a computer simulated isotherm distribution (1800°–2080° R) of an incoming gas in a prior art waste heat boiler employed downstream of a reformer in syngas generation without the impact bars in the impingement distributor.
Figure 17:
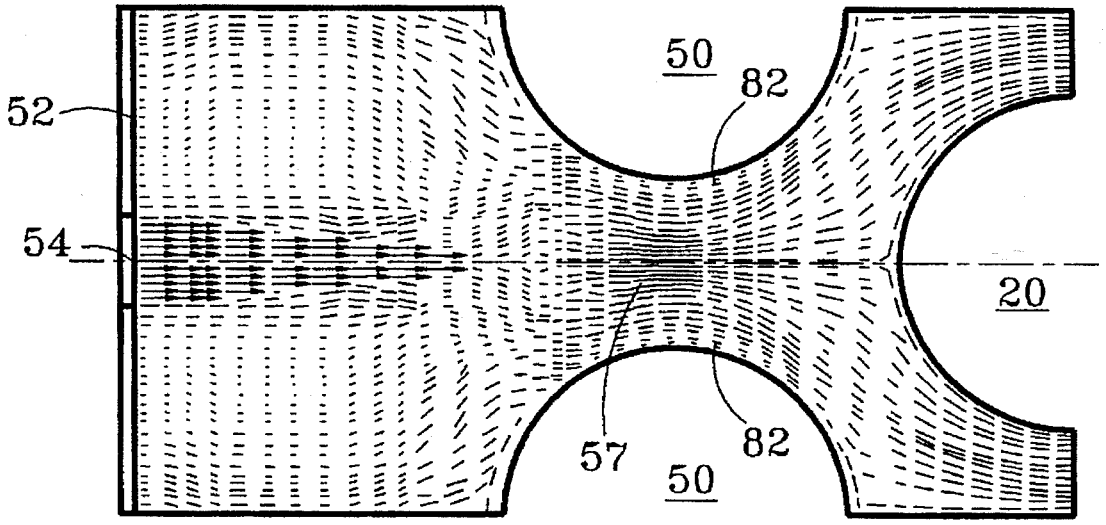
FIG. 17 (prior art) illustrates the velocity vectors of the incoming gas in the prior art boiler of FIG. 16.

Alternatively, for an impact bar having a concave cross-section and tubes having a circumferential pitch, impact bars 104 are desirably aligned with the adjacent tubes in an outer bank 50' as seen in FIGS. 8, 15–16. In addition, the impact bars 104 are positioned so that a concave surface 106 thereof is oriented toward the distributor plate 52 facing the column of perforations and spaced apart therefrom. In such a manner, impinging gases are reflected back upon the distributor plate 52 and through longitudinal slots 108 formed along the sides of the bars 104 (see FIG. 15). The spatial relationship between the impact bars 104 and the outer bank 50' defines an indirect flow path 110 through a gap 112 between adjacent outer bank tubes to avoid direct impinging flow. The impact bars 104 preferably comprise sections of tubing split in half longitudinally.

Referring particularly to FIGS. 2–5, 7–8 upper and lower seal plates 60, 62 are secured adjacent opposite longitudinal upper and lower ends of the distributor plate 52 and extend outward radially from the distributor plate 52 to adjacent the inside surface 46 of the shell 12 to form fluid seals at respective ends of the hot gas inlet annulus 48. The seal plates 60, 62 are secured to the distributor plate 52 by conventional means such as by welding. The seal plates 60, 62 (particularly the lower seal plate 62) are preferably reinforced by gussets (not shown) on a free surface thereof, and/or an adjacent reinforcing ring (not shown) secured thereto to inhibit buckling under the weight of the distributor 16.

Figure 3:
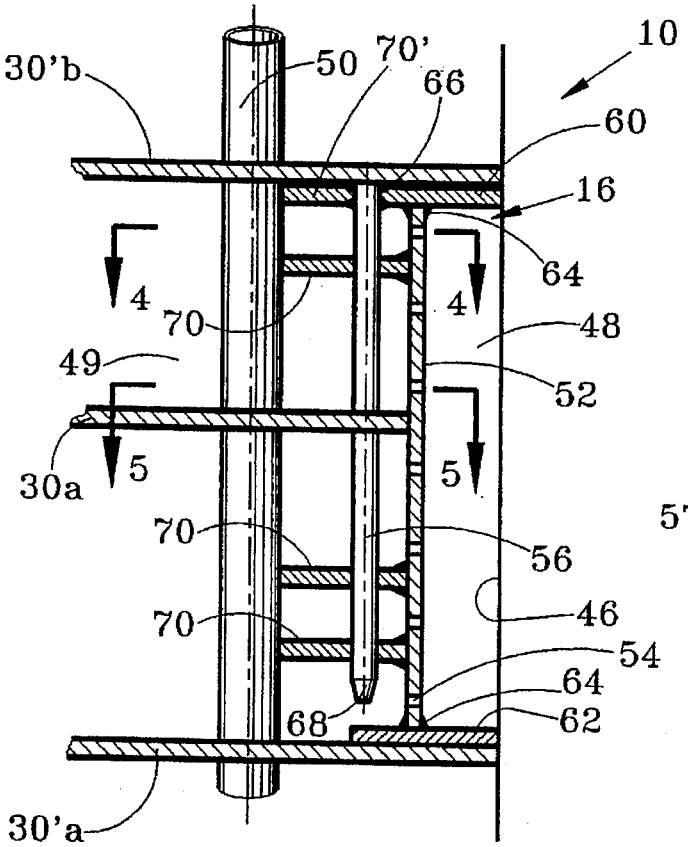
FIG. 3 is a detail longitudinal cross-sectional view of the impact bars, guide rings, and baffle and seal plates of the impingement distributor of FIG. 2.
Figure 4:
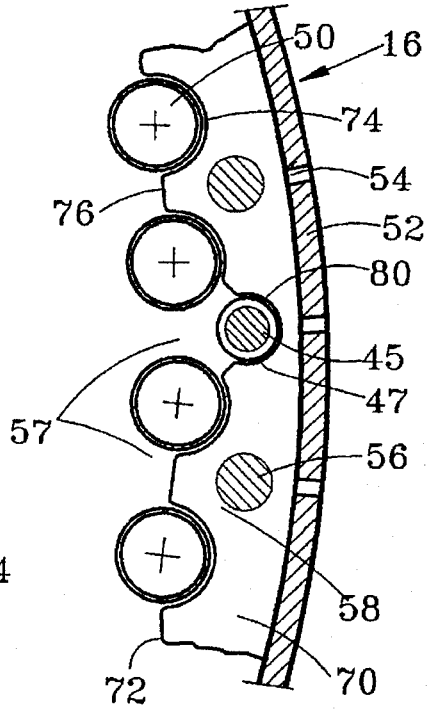
FIG. 4 is a partial plan view of the guide rings in the impingement distributor of FIG. 3 taken along the lines 4—4.
Figure 5:
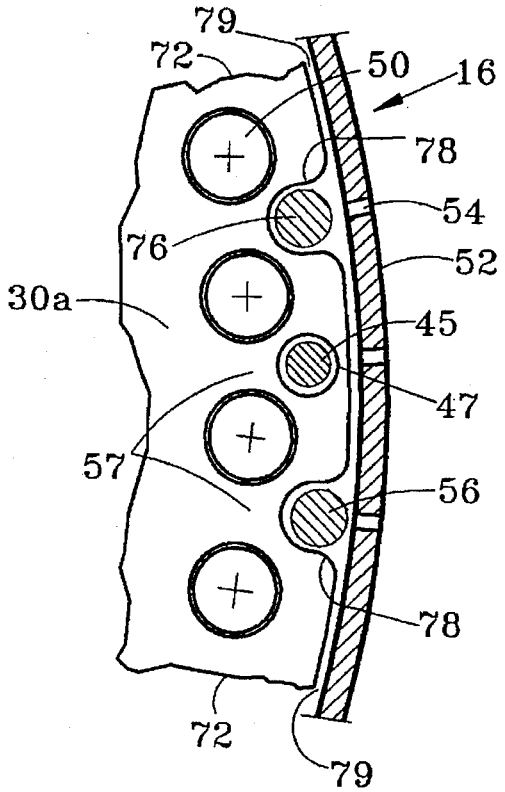
FIG. 5 is a partial plan view of the distributor baffle in the impingement distributor of FIG. 3 taken along the lines 5—5.
Figure 7:
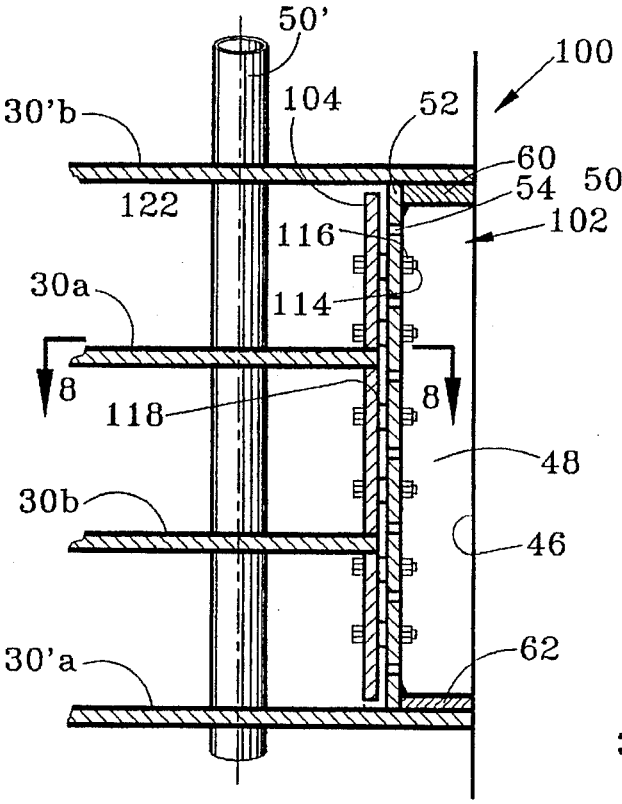
FIG. 7 is a detail longitudinal cross-sectional view of another embodiment of the impingement distributor of the present invention showing impact bars 102 bolted and spaced from the distributor plate inner surface.

The bars 56 of embodiment 10 are preferably secured, in turn, by a plurality of guide rings 70. As seen in FIG. 3, the bars 56 are secured at one end to an upper guide ring 70' by welding and a free end 68 is slideably received through the other openings of the guide rings 70 for maintaining the bars 56 in alignment with the rows of perforations 54 and for allowing thermal expansion of the bars 56 with respect to the guide rings 70.

The guide rings 70, 70' are preferably secured at spaced intervals along the length of the distributor plate 52 and extend inward radially therefrom to an inner profile 72 comprising radial grooves 74 and tongues 76 corresponding to a radial contour of the outer tube bank 50, and notches 80 corresponding to the radius of the tie rod spacer 47 for receiving the tubes 50 and tie rods 45.

The impact bars 104 (see FIGS. 7–10) are preferably secured to the distributor plate 52 by a plurality of bolts 114 having a nut 116 so that the concave surface 106 is disposed adjacent the plate inner surface and spaced therefrom by spacers 118 to form the longitudinal slots 108 between the bars 104 and the distributor plate inner surface as mentioned above. A plurality of regular longitudinally spaced recesses 120 are preferably formed on the bars 104 for receiving a generally hexagonal head 122 of the bolts 114. Once bolted, the nuts 116 are preferably welded to prevent loosening.

One or more of the baffle plates 30, 30' are distributor baffles **30*a*, 30*b* extending outward radially from the tube bundle 14 between the longitudinal ends of the distributor plate 52. Distributor baffles are provided with an outer profile 79 having peripheral notches 78 adjacent an inside surface of the distributor plate 52. The notches 78 laterally receive the impact bars 56, 104 to maintain radial alignment of the tube bundle 14 and tie rods 45 with respect to the distributor plate 52**. The number and shape of distributor baffles used will be a matter of practitioner preference.

In the design practice of the present invention, some of the tie rods 45 generally running the length of the tube bundle 14 to provide structural support for baffles and support plates can comprise impact bars in the embodiment 10 (see FIGS. 2–6). Similar to the impact bars 56, the tie rods 45 are disposed between the inner shell wall and the distributor plate 52 in longitudinal alignment with a row of perforations 54 and with the longitudinal gaps 57 between adjacent tubes in the outer bank 50. The number of impact bars which are tie rods will depend on mechanical support design criteria of the exchanger 10.

The distributors 16, 102 are preferably supported in the shell 12 by one of the baffles 30, 30' extending outward radially from the tube bundle 14 to adjacent the inside surface of the shell 12 below the lower end of the distributor plate 52. As seen in FIGS. 1–3 and 7, donut baffle plates longitudinally positioned adjacent the longitudinal ends of the distributor plate 52 define upper and lower support plates **30'*a*, 30'*b* so that the lower support plate 30'*b* abuts the lower seal plate 62. Typically in a cold state, the distributors 16, 102 are generally engaged only on the lower support baffle 30'*b* (as seen in FIGS. 1–3 and 7), but in a heated state, seal plates 60, 62 also expand against the inside wall 46 to a refractory lining 13 of the shell 12**.

Figure 6:
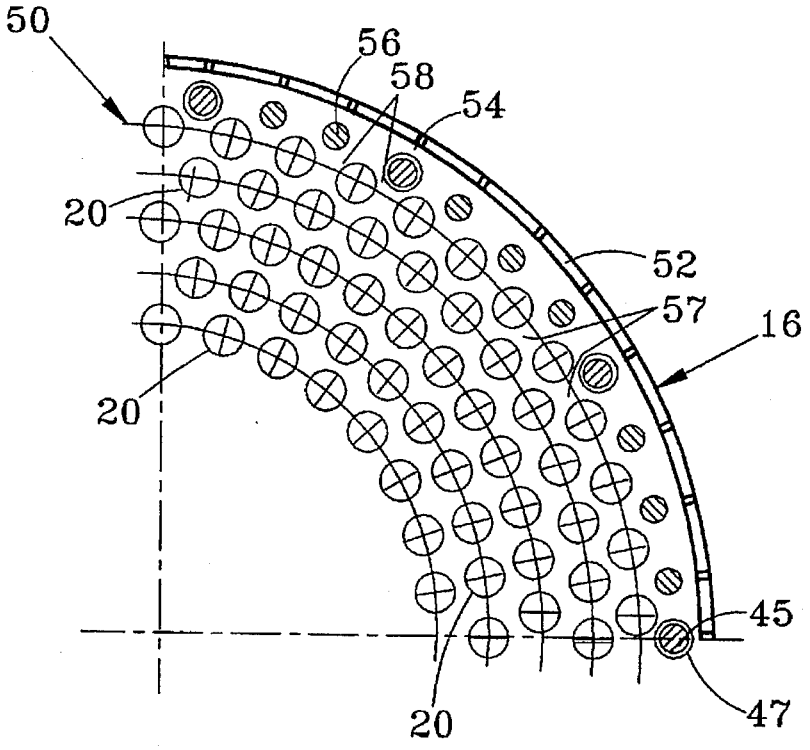
FIG. 6 is a partial plan view of the heat exchanger of FIG. 2 seen along lines 6—6 showing the orientation of the impingement distributor and tube banks.

Orientation of the tubes 20 in the tube bundle 14 and other design features thereof such as materials of construction are typically a matter of practitioner preference. As seen in FIGS. 6 and 8, a staggered tube orientation can be used.

Figure 9:
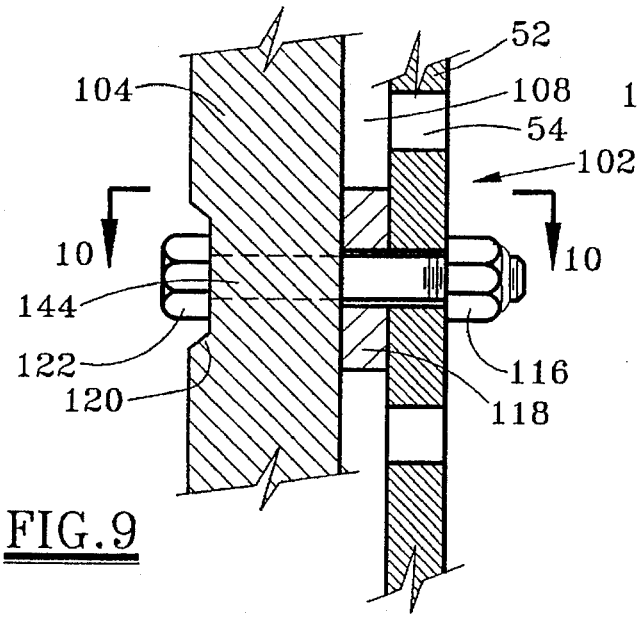
FIG. 9 is a detail view of FIG. 7 showing the impact bar 104.
Figure 10:
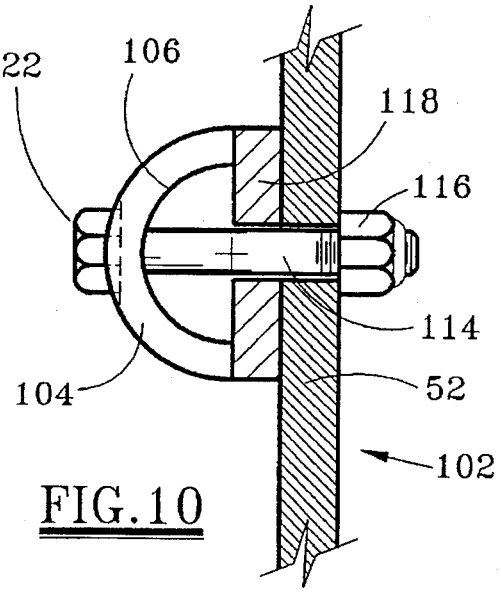
FIG. 10 is a plan view of the impact bar 104 of FIG. 9 taken along the lines 10—10 showing the concave surface 106 spaced adjacent the inner surface of the distributor plate.
Figure 11:
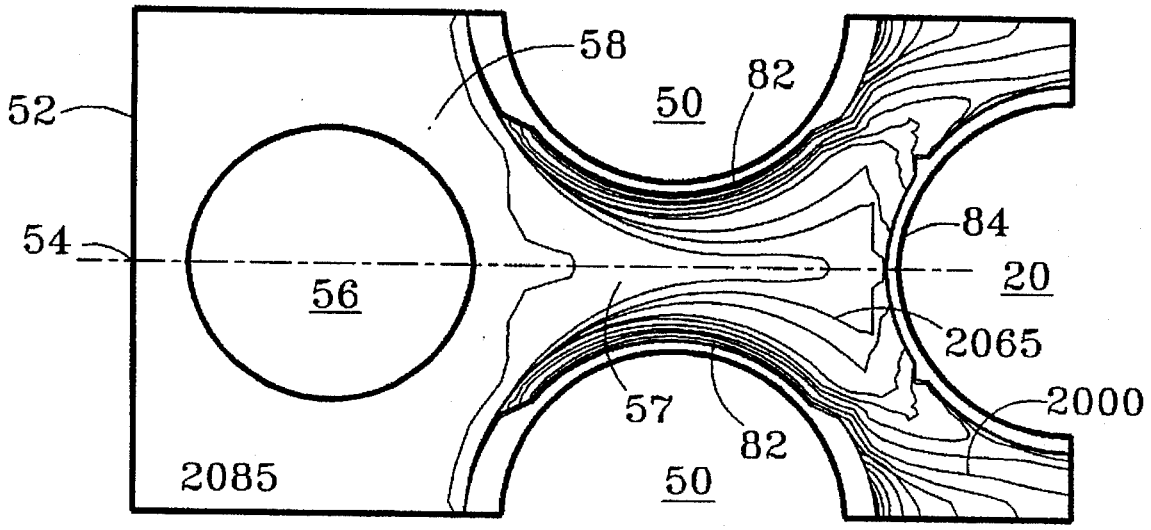
FIG. 11 illustrates a computer simulated isotherm distribution (1800°–2080° R) of an incoming gas in a waste heat boiler employed downstream of a secondary reformer in syngas generation showing an indirect flow path 58 defined by the impingement distributor embodiment of FIGS. 1–6.
Figure 12:
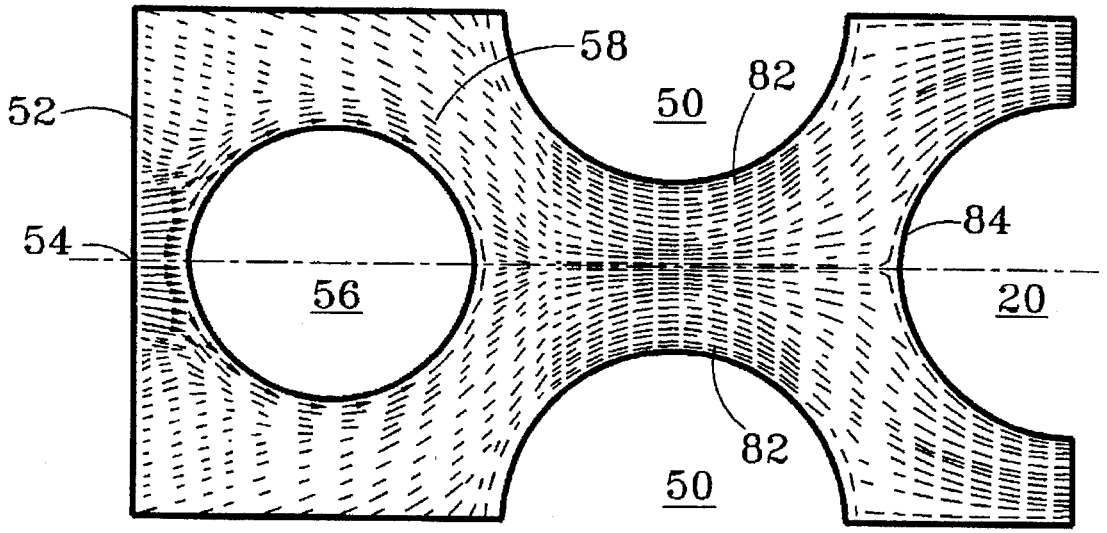
FIG. 12 illustrates the velocity vectors of the incoming gas at the indirect flow path 58 of FIG. 11 showing impingement on the impact bar 56.
Figure 13:
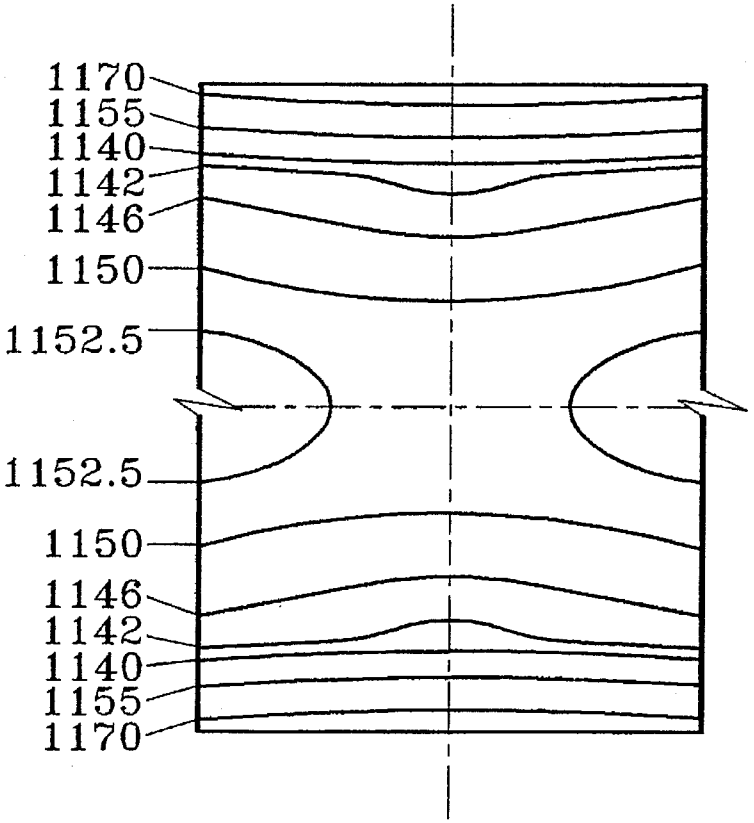
FIG. 13 illustrates isotherms of a tube wall 84 of FIG. 11 using the impact bars 56 to minimize direct impingement of the incoming gas on the tube wall 84.
Figure 18:
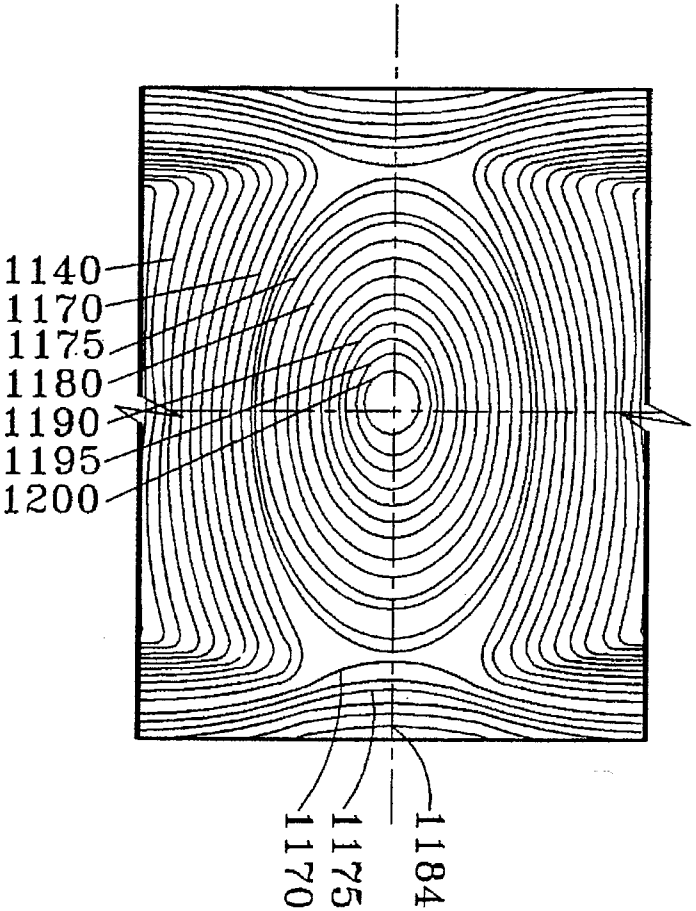
FIG. 18 (prior art) illustrates isotherms of a wall of a tube directly impinged by the incoming gas in the prior art boiler of FIG. 16.
Figure 14:
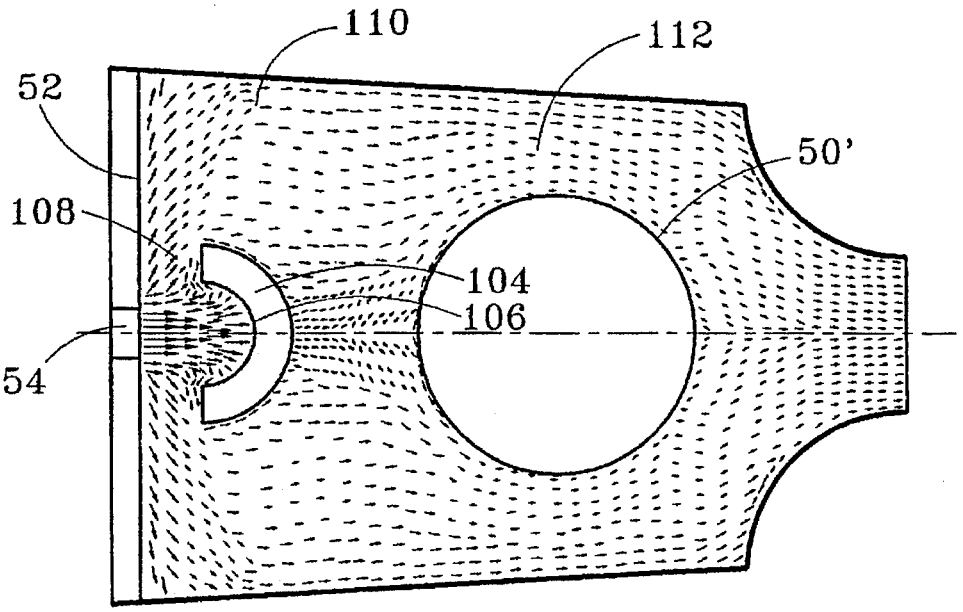
FIG. 14 illustrates computer simulated velocity vectors of an incoming gas in a waste heat boiler employed downstream of a secondary reformer in syngas generation showing an indirect flow path 114 defined by the impingement distributor embodiment of FIGS. 7–10.

Referring in particular to FIGS. 11–14 and 17–18 flow velocity vectors and temperature isotherms for a shell and tube exchanger used in a typical waste heat recovery application such as a methanol plant comprising the impingement distributor 16 of the present invention are simulated by computer and compared to a similar application wherein the impact bars 56 of the impingement distributors 16 are not employed. It can be seen that the hot gas temperature near a tube wall 82 in the longitudinal gap 57 remains essentially the same when the present impact distributor 16 is used. Thus, the present distributor 16 does not substantially interfere with the heat transfer in the exchanger 10. However, a comparison of wall isotherms of a tube 84 in longitudinal alignment to the perforations 54 with and without the impact bars 56 (as seen in FIGS. 9 and 12) shows that the impact bars 56 significantly reduce the maximum temperature seen by the tube wall (greater than 50° R).

Referring in particular to FIGS. 15–16, computer modeling is used to study velocity vectors for a shell and tube exchanger used in a typical waste heat recovery application such as a methanol plant comprising the impingement distributor 102. Heat transfer in the exchanger 100 is not interfered with and direct impingement on the outer tubes 50' (as indicated by small velocity vectors) is avoided.

To operate the shell and tube exchangers 10, 100 of the present invention, hot exhaust gases from which heat can be recovered are gathered and directed to the inlet nozzle 22 on the shell-side of the exchanger 10 for distribution through the annular channel 48 of the impingement distributor 16. In the distribution channel 48, the gas initially impinges the impact bars 56, 104 for deflection from direct impingement on the outermost tubes 50 thus reducing the temperature of the tube walls 84. Heat of the incoming gas is exchanged to a cool tube-side fluid, generally boiler feed water, flowing through the tubes 20. Cooled gas is then removed from the shell 12 of the exchanger 10 at the outlet nozzles 26. Heated boiler feed water is withdrawn from the exchanger 10 at the outlet nozzle 42.

The present shell and tube exchanger is illustrated by way of the foregoing description and examples. The foregoing description is intended as a non-limiting illustration, since many variations will become apparent to those skilled in the art in view thereof. It is intended that all such variations within the scope and spirit of the appended claims be embraced thereby.

We claim:

1. A shell and tube heat exchanger, comprising:

a tube bundle generally longitudinally disposed in the shell for passing a tube-side fluid through the exchanger;

a shell-side inlet in fluid communication with an annular distribution channel defined by a cylindrical distributor plate disposed around the tube bundle and spaced from an inside surface of the shell;

a plurality of perforations formed in the distributor plate to distribute fluid from the annular channel to flow through the tube bundle across outer surfaces of the tubes to a shell-side fluid outlet;

a plurality of impact bars disposed between a bank of outer tubes of the bundle and an inner surface of the distributor plate wherein the bars oppose each of the perforations for fluid passing through the perforations to impinge on the bars and avoid direct impingement of the hot gas on the tubes.

2. The shell and tube heat exchanger of claim 1, wherein the perforations are arranged in a plurality of longitudinal rows and an impact bar is longitudinally aligned with each row of perforations and runs the general length thereof.

3. The shell and tube heat exchanger of claim 1, comprising:

first and second annular seal plates at opposite ends of the distribution channel extending outward radially from the distributor plate to adjacent the inside surface of the shell.

4. The shell and tube heat exchanger of claim 2, comprising:

one or more distributor baffles extending outward radially from the tube bundle to adjacent the inner surface of the distributor plate; and notches formed in an outer profile of the distributor baffle(s) to radially receive the impact bars and maintain radial alignment of the tube bundle with respect to the distributor plate and impact bars.

5. The shell and tube heat exchanger of claim 4, wherein the impact bars are aligned with a longitudinal gap between adjacent tubes in the outer bank.

6. The shell and tube heat exchanger of claim 5, comprising:

a plurality of longitudinally spaced-apart guide rings secured to the distributor plate and extending inward radially therefrom; and longitudinal holes formed in the guide rings receiving the impact bars to maintain the impact bars in radial alignment with respect to the distributor plate.

7. The shell and tube heat exchanger of claim 6, wherein the guide rings have an inner profile corresponding to a contour of the outer tube bank.

8. The shell and tube heat exchanger of claim 7, wherein at least some of the impact bars comprise tie rods generally running the length of the tube bundle.

9. The shell and tube heat exchanger of claim 4, wherein the impact bars have a concave surface disposed adjacent the inner surface of the distributor plate and spaced therefrom, and wherein the impact bars are aligned with adjacent tubes in the outer bank.

10. The shell and tube heat exchanger of claim 9, wherein the impact bars are attached to the distributor plate by bolts and spaced from the inner surface of the distributor plate by spacers.

11. A waste heat boiler, comprising:

a refractory-lined cylindrical shell housing a longitudinal tube bundle and including respective tube-side and shell-side fluid inlets and outlets;

a plurality of baffles perforated to slideably receive and maintain radial alignment of tubes in the tube bundle, wherein the baffles are spaced apart longitudinally by tie rods passing through bores in the baffles and annular spacing elements having an outer diameter larger than the bores;

a cylindrical distributor plate disposed around the tube bundle and radially spaced from an inside surface of the shell to form a hot gas inlet annulus in fluid communication with the shell-side fluid inlet;

upper and lower seal plates secured adjacent opposite longitudinal upper and lower ends of the distributor plate and extending outward radially therefrom to adjacent the inside surface of the shell to form fluid seals at respective ends of the hot gas inlet annulus;

wherein one of the baffles is a support baffle extending outward radially from the tube bundle to adjacent the inside surface of the shell below the lower end of the distributor plate to support the distributor plate on an upper surface of the support baffle;

a plurality of perforations formed in the distributor plate arranged in spaced-apart longitudinal rows;

a plurality of longitudinal impact bars disposed adjacent an outer periphery of the tube bundle and an inner surface of the distributor plate, each aligned with and opposing a row of the perforations for hot gas passing through the perforations to impinge directly on a respective impact bar and then pass between adjacent impact bars into the tube bundle;

wherein one or more of the baffles are distributor baffles extending outward radially from the tube bundle between the longitudinal ends of the distributor plate, and including an outer contour adjacent the inside surface of the distributor plate having peripheral notches to laterally receive the impact bars and maintain radial alignment of the tube bundle and tie rods with respect to the impact bars and distributor plate.

12. The boiler of claim 11, wherein one of the baffles is a support baffle extending outward radially from the tube bundle to adjacent the inside surface of the shell above the upper end of the distributor plate to vertically position the distributor plate between the upper and lower support baffles.

13. The boiler of claim 12, wherein the tubes are arranged in a circular pattern concentric with the distributor plate.

14. The boiler of claim 13, wherein some of the impact bars are tie rods, the perforations in the distributor plate are aligned with a gap between adjacent tubes in an outermost bank, and the impact bars and tie rods opposite the perforations are arranged in a circle concentric with the distributor plate.

15. The boiler of claim 14, including a plurality of guide rings secured at spaced intervals along the length of the distributor plate and extending inward radially therefrom to an inner profile corresponding to a radial contour of the tube bundle and tie rods, wherein the guide rings are perforated to receive and maintain the impact bars in the alignment with the rows of perforations.

16. The boiler of claim 15, wherein the impact bars are secured to one of the guide rings and slideably received in the perforations of the other guide rings to allow for longitudinal thermal expansion.

17. The boiler of claim 13, wherein the impact bars have a concave surface disposed adjacent the inner surface of the distributor plate and spaced therefrom, and the perforations in the distributor plate are aligned with adjacent tubes in an outermost bank.

18. The boiler of claim 17, wherein the impact bars are attached to the distributor plate by bolts and spaced from the distributor plate inner surface by spacers.

19. The boiler of claim 12, wherein the baffles have a disk and donut configuration wherein the support baffles comprise donuts.

20. The boiler of claim 19, wherein the distributor baffles comprise disks.

21. A method for recovering waste heat from a hot gas in a shell and tube heat exchanger having a tube bundle generally longitudinally disposed in the shell for passing a tube-side fluid through the exchanger, comprising the steps of:

(a) directing the hot gas to an annular distribution channel of the shell and tube heat exchanger, the annular distribution channel in fluid communication with a shell-side inlet and defined by a cylindrical distributor plate disposed around the tube bundle and spaced from an inside surface of the shell;

(b) distributing the hot gas from the annular channel to flow through a plurality of perforations formed in the distributor plate, through the tube bundle across outer surfaces of the tubes, and to a shell-side gas outlet;

(c) impinging the fluid passing through the perforations against a plurality of impact bars disposed between a bank of outer tubes of the bundle and an inner surface of the distributor plate wherein the bars face the perforations;

(d) transferring heat from the gas distributed by the distributor plate to the fluid flowing through the tube bundle;

(e) withdrawing a cooled gas from the shell-side outlet and a heated fluid from a tube-side outlet.

* * * * *